US010556421B2

(12) United States Patent
Vogt

(10) Patent No.: US 10,556,421 B2
(45) Date of Patent: Feb. 11, 2020

(54) PAD PRINTING MACHINE

(75) Inventor: Udo Vogt, Rottenburg (DE)

(73) Assignee: ITW MORLOCK GMBH, Dornstetten (DE)

( * ) Notice: Subject to any disclaimer, the term of this patent is extended or adjusted under 35 U.S.C. 154(b) by 2374 days.

(21) Appl. No.: 12/999,224

(22) PCT Filed: Jun. 17, 2009

(86) PCT No.: PCT/IB2009/052589
§ 371 (c)(1),
(2), (4) Date: Dec. 15, 2010

(87) PCT Pub. No.: WO2009/153744
PCT Pub. Date: Dec. 23, 2009

(65) Prior Publication Data

US 2011/0100241 A1 May 5, 2011

(30) Foreign Application Priority Data

Jun. 19, 2008 (DE) ..... 10 2008 029 299

(51) Int. Cl.
*B41F 17/14* (2006.01)
*B41F 9/01* (2006.01)
*B41F 9/06* (2006.01)
*B41F 17/00* (2006.01)

(52) U.S. Cl.
CPC ..... *B41F 17/001* (2013.01)

(58) Field of Classification Search
CPC ..... B41F 17/001; B41F 17/14; B41F 9/01; B41F 9/06; B41F 3/36; B41P 2233/50; B41P 2233/52
USPC ..... 101/41, 44, 163
See application file for complete search history.

(56) References Cited

U.S. PATENT DOCUMENTS 5,134,932 A 8/1992 Fujino
5,136,948 A 8/1992 Fujino et al.
5,367,953 A * 11/1994 Yamashita et al. ..... 101/158
5,383,398 A 1/1995 Binnen
5,622,041 A 4/1997 Feeley et al.
5,996,486 A 12/1999 Karlyn et al.
(Continued)

FOREIGN PATENT DOCUMENTS

DE 69711043 T2 11/2002
DE 102005060550 A1 6/2007
(Continued)

OTHER PUBLICATIONS

Partial English translation of JP 06-134977A, publication date May 17, 1994.*
(Continued)

*Primary Examiner* — Leslie J Evanisko
(74) *Attorney, Agent, or Firm* — Pilloff Passino & Cosenza LLP; Martin J. Cosenza

(57) ABSTRACT

A pad printing machine configured to print an object in at least two stages includes at least one printing pad to print the object and at least two printing plate zones within each of which a printing plate may be moved into the desired position. The pad printing machine further includes an image recorder configured to generate an image of at least a partial area of at least one printing plate zone, and a comparator configured to compare the image generated by the recorder with reference data.

17 Claims, 4 Drawing Sheets

(56) References Cited

U.S. PATENT DOCUMENTS

| | | | | |
|---|---|---|---|---|
| 6,036,994 | A | 3/2000 | Tanaka et al. | |
| 6,393,981 | B1 | 5/2002 | Cameron | |
| 7,665,983 | B2 | 2/2010 | Kendale et al. | |
| 2008/0276813 | A1 * | 11/2008 | Chapman | 101/163 |
| 2008/0314266 | A1 | 12/2008 | Reinholdt | |

FOREIGN PATENT DOCUMENTS

| | | | | |
|---|---|---|---|---|
| EP | 0379447 | A1 | | 7/1990 |
| JP | 06134977 | A | * | 5/1994 |
| JP | 07017029 | A | * | 1/1995 |
| WO | WO 2005056294 | A1 | * | 6/2005 |
| WO | 2005068199 | A1 | | 7/2005 |

OTHER PUBLICATIONS

Partial English translation of JP 07-17029A, publication date Jan. 20, 1995.*

ISR for PCT/IB2009/052589 dated Nov. 9, 2009.

German Search Report for App. No. 10 2008 029 299.0 dated Jan. 9, 2009.

* cited by examiner

PAD PRINTING MACHINE

RELATED APPLICATIONS

The present application is national phase of International Application Number PCT/IB2009/052589 filed Jun. 17, 2009, and claims priority from, German Application Number 10 2008 029 299.0 filed Jun. 19, 2008.

TECHNICAL FIELD

The present invention relates to a pad printing machine used to print an object in at least two stages, also to a method for printing an object in at least two stages using a pad printing machine.

BACKGROUND

Pad printing machines, hereafter also shortened to "printing machines", illustratively are known from the patent documents U.S. Pat. No. 5,622,041; 6,393,981 B1; EP 0 379 447 A1 and DE 10 2005 060 550. Illustratively as regards the printing machine of DE 2005 060 550, a printing unit carrier receives several printing units. This plurality of printing units allows printing an object in several stages on a single machine, where, besides the feasibility of polychrome printing, for instance red in a first printing stage and black in a second, it is possible also to print in several stages using a single printing ink/color.

Printing objects in multiple stages is fairly time-consuming due to precisely arranging the various printing stages in a manner that they are in register relative to each other in these individual stages and be commensurately applied to the object. The relative register of printing of one stage with respect to the object respectively the position of printing of the further stages to this date generally has been set manually by the operator of the particular printing machine. In such a procedure the position of a printing plate zone, which typically encompasses a printing plate support holding a printing plate, is shifted respectively varied in each printing stage until the desired print positions on the objects have reached the desired positions of the individual stages. The adjustment per se is complex and requires skilled operators.

SUMMARY

The object of the present invention is to create a pad printing machine offering a the minimum of two-stage object printing, the machine simplifying positional printing accuracy during the various object printing stages, namely simplified adjustment of the printing machine. The objective of the present invention moreover is a corresponding method to print an object in at least two procedural steps using a pad printing machine respectively a method for adjusting/registering a pad printing machine, the method being simpler than the procedures of the state of the art.

BRIEF DESCRIPTION OF THE DRAWINGS

The present invention is elucidated below in relation to the appended drawings and by preferred embodiment modes.

DETAILED DESCRIPTION

Figure 1:
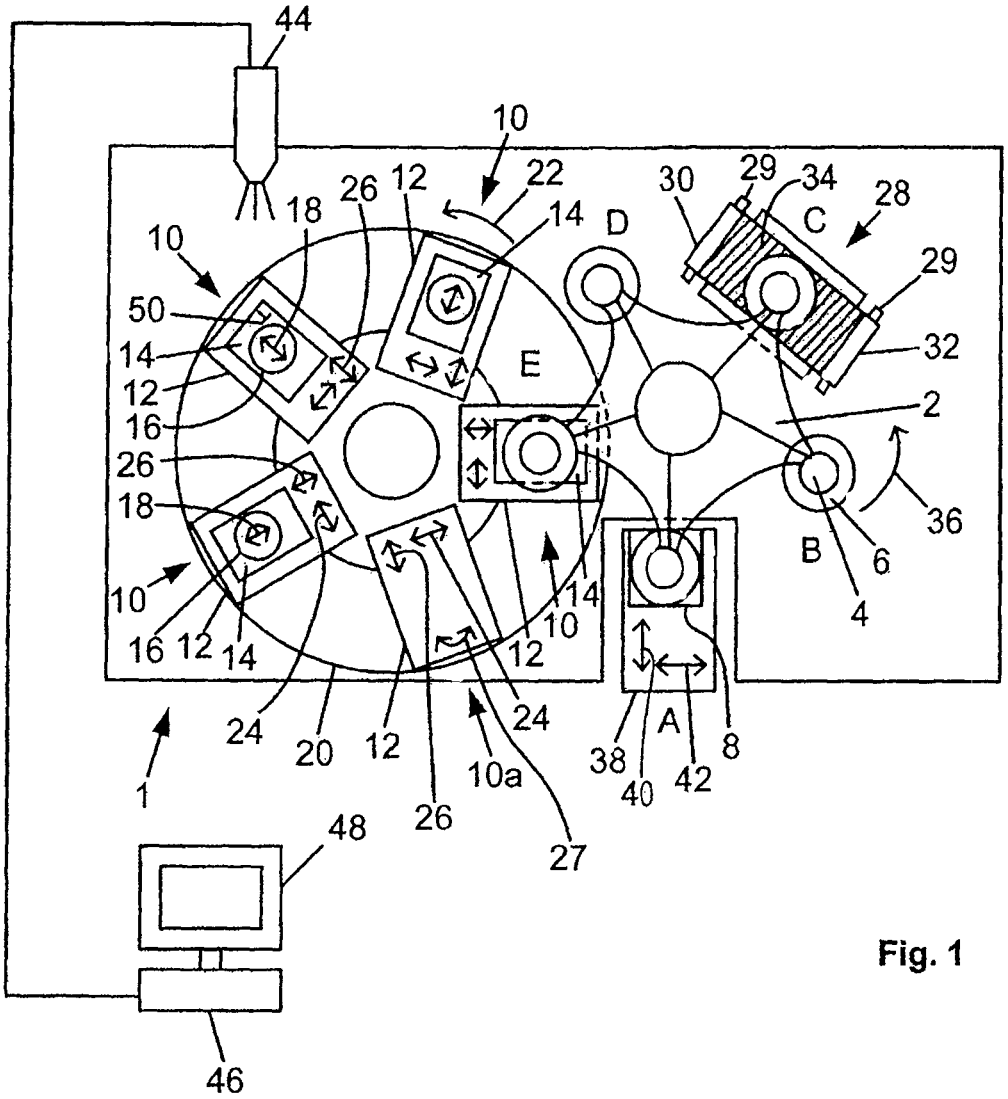
FIG. 1 is a schematic topview of a pad printing machine of a first preferred embodiment mode of the present invention.

FIG. 1 schematically shows the structure of a pad printing machine 1 of a first preferred embodiment mode of the present invention. Therein the pad printing machine 1 comprises a printing unit carrier 2 to which are affixed a plurality (two or more) pad supports 4. In turn a printing pad 6 is affixed to each of the supports 4. The printing unit carrier 2 displaces the pad supports 4 together with the printing pads 6 along a closed track and consecutively to a plurality of stop stations, for instance the stations A, B, C, D and E of which at least one stop station, in the present first preferred embodiment mode the stop station A is a printing station where an object 8 can be or is printed.

The first preferred embodiment mode of a pad printing machine of the invention furthermore comprises five printing plate zones 10, 10*a* each related to one printing stage and each of which is fitted with a printing plate carrier in the form of an x-y platform. The printing plate carriers 12 receive printing plates 14 or similar. A print image is subtended by one or more recesses in each case on the upward pointing surface of a printing plate 14.

The print image in each case is situated underneath an ink cup 16 resting by its cup rim acting as a doctor and pointing downward rests on the upward pointing surface of the printing plate 14. In this configuration the print image is situated underneath the ink cup 16 and within latter's rim, as a result of which ink may be received in the print-image recess(es) while nevertheless being precluded from leaking out of the ink cup 16 at the doctor edge. The recess(es)—which constitute(s) a print image at the surface—may be made by etching or other techniques applied to the printing plate 14. In order to allow releasing the print image for purposes of ink transfer to the printing pad 6, the ink cup 16 is mounted in longitudinally displaceable manner on the printing plate 14 (as indicated by the double arrow 18).

The printing plate zones 10, 10*a* together with the printing plate carriers 12 and the printing plates 14 (the printing plate 10 is devoid of any printing plate 14) are configured on a turntable rotatable about a central, vertical axis (indicated by the arrow 22). A drive is used to displace the turntable and is fitted with a drive-force generator, preferably a pneumatic, hydraulic or electric drive-force generator, for instance an electric motor. The turntable 20 may be rotated by the drive in the same but also in opposite directions by at least 360° or preferably by arbitrarily frequent revolutions beyond 360°. In such a procedure the turntable is rotated by a predetermined value angular units. In the above described first preferred embodiment mode, the drive is a stepping drive, illustratively an electric stepping motor, the number of displacement steps required to rotate the turntable 20 by another angular unit being adjustable.

In order to position in register the printing plate carrier 12 together with the printing plates 14 underneath the printing pad 6, the printing plate carriers 12 are designed as x-y platforms displaceable both in a radial direction (relative to the turntable 20) and in a direction perpendicular thereto on the turntable 20 (indicated by the double arrows (24, 26). Also the x-y platforms are supported rotatably about an axis (indicated by the double arrow 27) parallel to the central vertical axis allowing and assuring angular displaceability of the x-y platforms (printing plate carriers 12).

In the present first preferred embodiment mode, the stop station E is designed as the print image transfer station where the particular printing pad 6 comes to rest on at least one partial area of the printing plate 14 and picks up ink from the recess(es) in the printing plate (14) (print image). The further stop stations, for instance B, C, D may be empty or (as designed at the stop station C in the presently discussed preferred embodiment mode of an inventive pad printing machine), they may be fitted with a cleaning system 28. The cleaning system 28 comprises two roll carriers 29 which may be fitted with both a cleaning band dispenser roll 30 and a cleaning band take-up roll 32. A cleaning band moving at a predetermined speed underneath the printing pad 6 configured at the stop station C is guided between these two rolls 30, 32. When the printing pad 6 of the stop station A is moved down for the transfer of the print image transfer, then simultaneously the printing pad 6 of the stop station C is moved down to be pressed against the cleaning band.

In the first preferred embodiment and as shown in FIG. 1, the printing unit carrier 2 is a rotational structure in the form of a turntable respectively a rotary table or a turnstile rotatable about a central vertical axis (indicated by an arrow 36). The printing unit carrier 2 is moved by a drive which is fitted with a preferably pneumatic or hydraulic or electric drive force generator, for instance an electric motor. The printing unit carrier 2 is rotatable by the drive in the same direction by at least 360° or preferably by an arbitrary number of revolutions in the same direction beyond 360°. In the process the printing unit carrier 2 is rotated by predetermined angular units either from stop station A through E or from set to set of such stations, each set containing at least two of the stop stations A through E. In the discussed preferred embodiment, the drive is a stepping drive, preferably an electrical stepping motor, the number of displacement steps required to rotate the printing unit carrier 2 each time by one angular unit being adjustable.

Five pad support seats are distributed on the printing unit carrier 2 over 360° and about its vertical axis of rotation, holding at least two pad supports, preferably more than two, in the preferred first embodiment mode four pad supports 4, each support holding one printing pad 6. The pad support seats are arrayed in predetermined circumferential angular positions that the printing pad supports 4 received in them (together with the associated printing pads 6) are able to print an object at the printing station A. Preferably the circumferential angular positions are equidistant. Preferably too the printing pads 6 each are situated the same radial distance from the axis of rotation of the printing unit carrier 2.

To print the object 8 and in particular to reliably secure it in its position, an object carrier 38 is mounted on the stop station A and keeps the minimum of one object 8 to be printed in a known printing position where the object can be printed by the printing pad 6. Again, simultaneously and in known manner, several objects 8 may be present on the object carrier 38 and are moved consecutively from the object carrier 38 into a suitable printing position and then away from it. As implemented in the preferred embodiment mode and as indicated by the double arrows 40, 42, the displacements of the object carrier 38 may be linear, or, alternatively, rotational (in the latter case the object carrier 38 as a rule would be in the form of a turntable or a turnstile and be configured rotatably about a vertical axis of rotation. The object carrier 38 is fitted with a displacement drive which comprises an electric, hydraulic or pneumatic drive force generator, being preferably displaceable stepwise and coordinated with the rotary motions of the printing unit carrier 2. The object carrier 38 may be loaded and cleared manually or preferably using a feeding and removing device, for instance by a loading and removing station, in automated manner.

The pad supports 4 together with printing pads 6 are rigidly joined to the printing unit carrier 2. At each station the printing unit carrier 2 is moved respectively pulled down using an appropriate drive (in alternative embodiments it is pressed down), as a result of which the printing pad at the stop station A is pressed on the object while the printing pad at the stop station B is pressed on the corresponding printing plate 14 and the printing pad at the stop station C is pressed against the cleaning band 34. In this manner three operational procedures are carried out simultaneously at the three different stations A, C, E, namely printing of the object, cleaning of a pad and ink pickup by the pad which in the next step shall be guided to the stop station A. It is understood that that the cleaning station 28 may optionally be switched on with a delay, for instance a pad being cleaned only at the fifth or tenth pass.

As regards the first preferred embodiment mode (see in particular FIG. 2 which is a partial elevation of that first preferred embodiment), the pad printing machine 1 is fitted with an image recorder 44 in the form of a CCD camera generating an image of the particular printing plate zone 10, 10*a* underneath the recorder. The first preferred embodiment further is fitted with a comparator 46 comparing the image generated by the recorder 44 or data secured from it for instance by an analyzer with reference data. In the preferred embodiment mode the comparator 46 is electronic (a computer) and allows comparing the image generated from the printing plate zone 10 with a reference image (in this instance the reference data are a graphic). For that purpose the reference image—which is an image of parts of the printing plate zone 10 of the first printing stage (in the first preferred embodiment an image of part of a zone of printing plate 14 of the first printing zone)—is represented as background on a screen 48 of the comparator 46, whereas the (present) image of the printing plate zone 10 of a second or further printing stage is placed over respectively projected on, the background image. In the discussed preferred embodiment mode, the present picture is superposed in video form—that is as a continuous sequence of individual images on the reference image, whereby the present state (the present position of the printing plate zone of the second or further printing step) can be compared in real time with the reference image. To implement such a comparison, the above reference data contain an image of at least parts of the printing plate zone 10 of the first printing stage. As a result the positions of the printing plate zone 10, of the second and further printing stages, can be matched accurately and reliably to one another and to the printing plate zone 10 of the first printing stage.

In an alternative embodiment mode, instead of adjusting the position of the printing plate 10, the position of the object carrier 38 may be adjusted by a control unit to the particular printing stage, respectively.

In this manner the different stages' printings can be exactly in register at the different sites on the object. When the printing plate zone 10*a*—which is devoid of a printing plate 14—assumes the position seen/recorded by the camera, image comparison does not take place.

The comparison between the present image and the reference data respectively the reference image may be applied to an arbitrary, distinctive point respectively arbitrary distinctive points of the printing plate zones 10. Illustratively the edges of the printing plate carriers 12 may be detected respectively determined. Other distinctive points may be in the form of markings on the printing plate carrier 12 respectively also on the printing plate 14 itself. In the preferred embodiment mode of FIGS. 1 and 2, the marking is a position marker respectively a register mark 50 on the printing plate 14 Such mark(er) assumes the form of a cross with only half a transverse bar or is another, arbitrary mark(er) preferably unambiguous about its position on the printing plate 14.

Obviously as well, besides comparing pictures, coordinates too may be compared, or any other conceivable comparison of positions may be used. As regards coordinates' comparisons, illustratively those of significant points would be determined manually (for instance by a mouse pointer on the image screen) or automatically (for instance using an automated recognition algorithm) by means of the comparator, and then the coordinates would be compared. Such a procedure offers the advantage that merely coordinate data, that is a relative modest set of data, would need being stored instead of a reference image. On the other hand image comparison offers the advantage that even a relatively inexperienced machine operator may ascertain quickly and in real time whether the register marks 50 respectively the significant points are superposed or whether adjustment respectively resetting either the printing plate zone must be carried out, in particular the printing plate carrier or also the object carrier requiring adjustment (alternatively to matching the position of the printing plate zone respectively the printing plate carrier for each printing stage, the object carrier also may be moved into the desired position for each such printing stage). In the preferred embodiment mode, the desired position adjustment of the particular printing plate zone 10 is implemented by adjusting the printing plate carriers 12 (x-y platforms).

In an alternative embodiment mode, instead of adjusting the position of the printing plate 10, the position of the object carrier 38 may be adjusted by a control unit to the particular printing stage, respectively.

If the register mark 50 (illustratively several register marks 50 may also be used) is deposited on the printing plate 14, accurate positioning of the various printing stages relative to each other is relatively easily implemented because the printing plates can be manufactured to be fitted with a fixed reference element of the print image of all printing stages relative to the defined and fixed positions of the register marks 50.

It should be kept in mind in this respect that the x-y platform (printing plate carrier 12) of the first preferred embodiment mode is manually adjustable by the operator of the printing machine 1 using three hand wheels 52 (x, y and angular positions).

Figure 2:
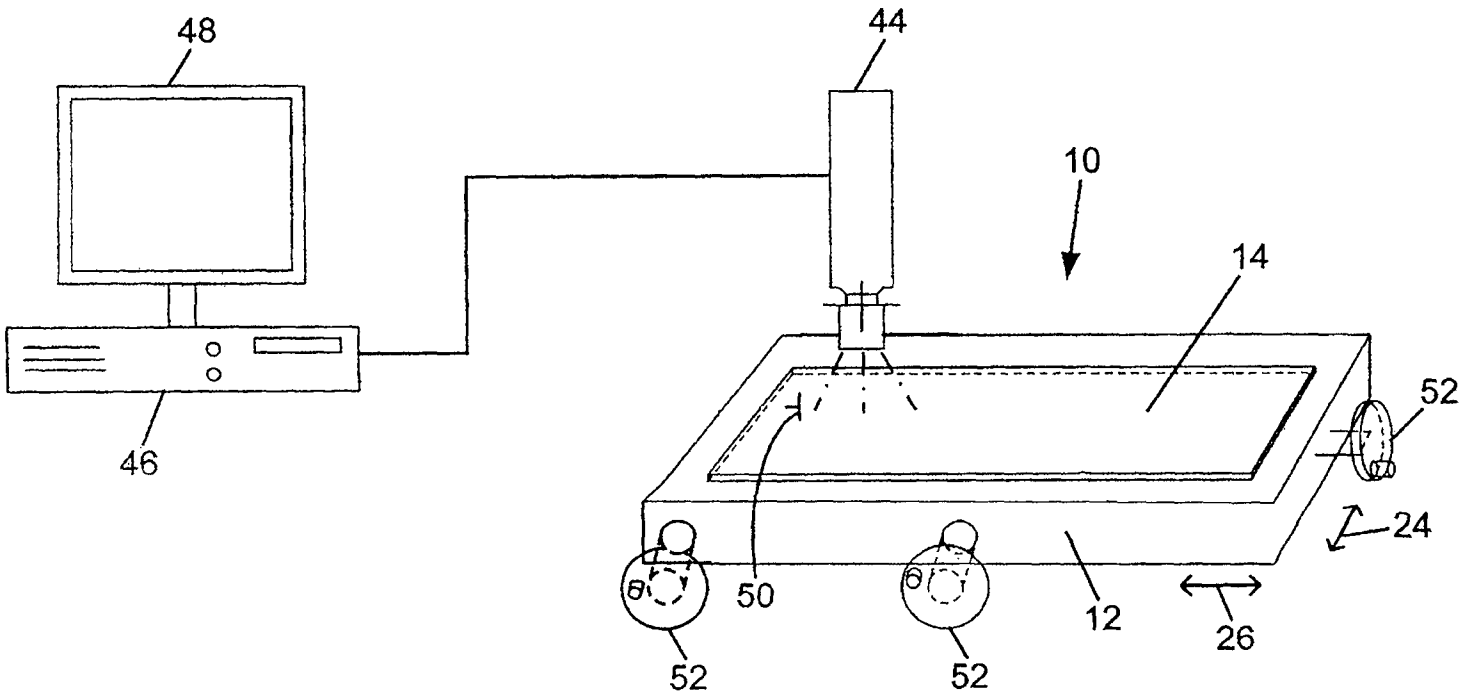
FIG. 2 is a partial elevation of the first preferred embodiment mode of FIG. 1.
Figure 3:
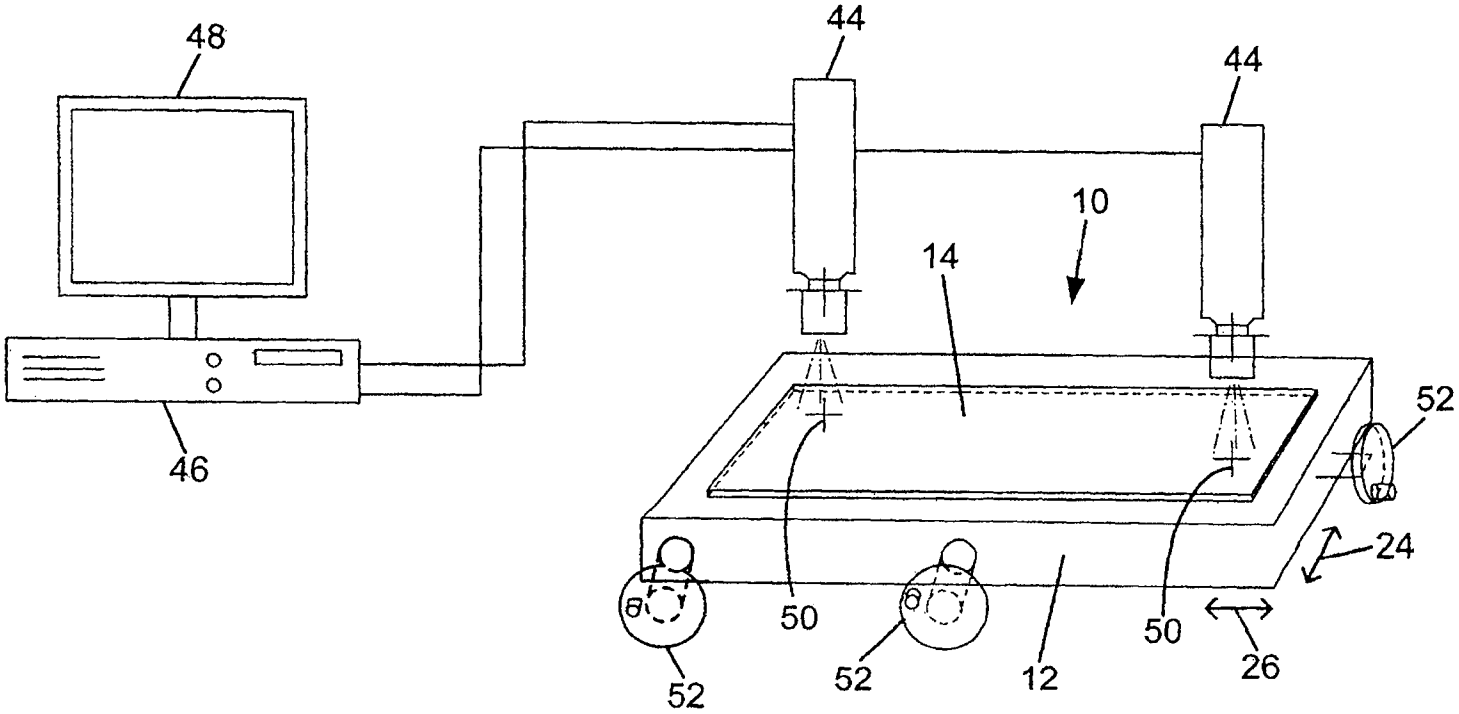
FIG. 3 is a partial elevation of a second preferred embodiment mode of a pad printing machine of the invention.

FIG. 3 is a partial elevation of a second preferred embodiment mode of a pad printing machine 1 of the present invention. FIG. 3, as does FIG. 2, shows the printing plate zone 10, the comparator 46 and the image recorder 44 of the invention. In the second preferred embodiment of the invention however the image recorder 44, contrary to the case of the first preferred embodiment, comprises two CCD cameras, as a result of which two partial areas of the printing plate zones 10 are shown graphically. In this second preferred embodiment mode, two corner zones of the printing plate zone 10 can always be recorded and evaluated for the printing plate 10 in the corresponding position. A cruciform register mark 50 is apposed in these two areas of the particular printing plate. Both cameras are connected to the comparator 46 (in the form of a computer) as in the case of the embodiment of FIGS. 1 and 2 and enable comparison with a reference graphic respectively with reference data.

Figure 4:
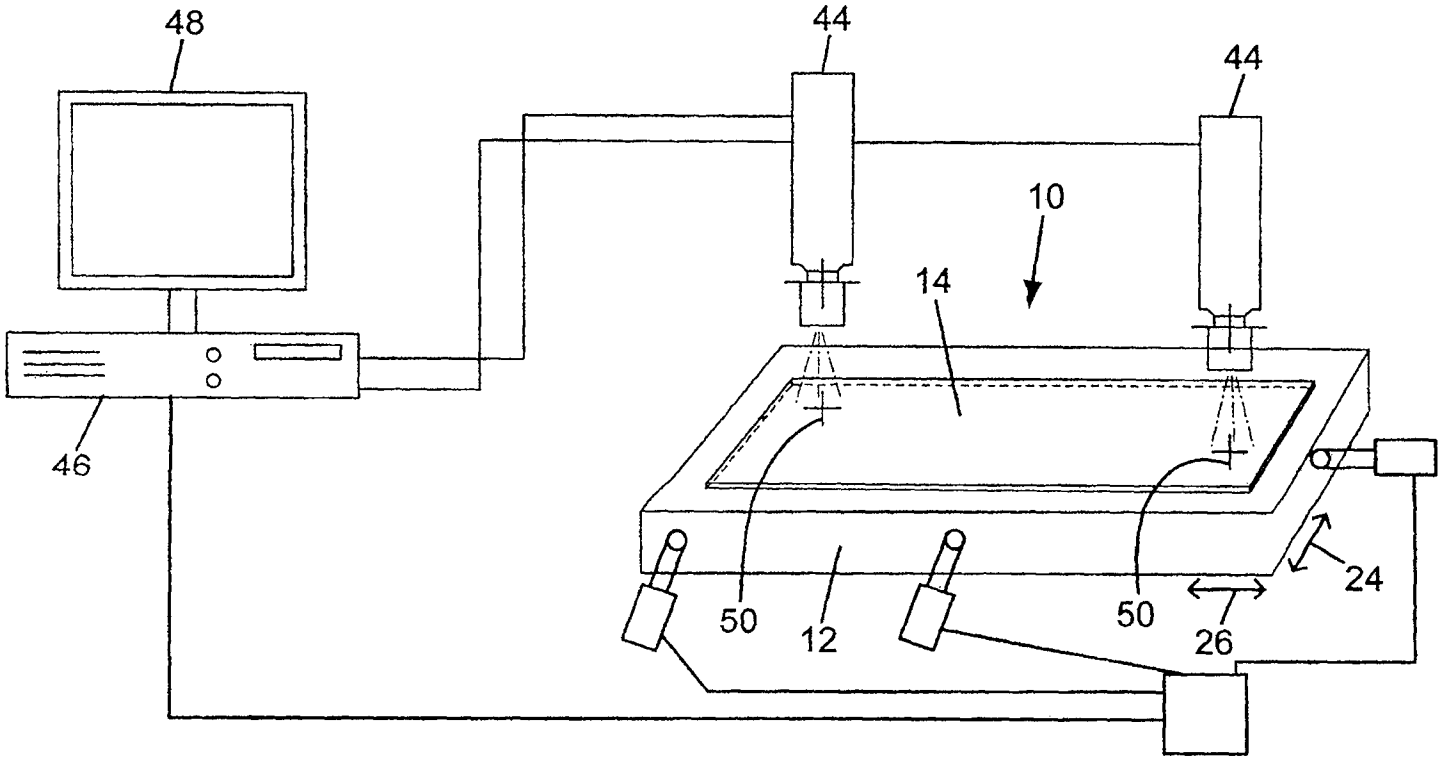
FIG. 4 is a partial elevation of third preferred embodiment of a pad printing machine of the invention.

Lastly FIG. 4 shows a third preferred embodiment mode of a pad printing machine 1 of the present invention corresponding substantially to the second preferred embodiment mode. However, contrary to the case of the second embodiment mode, the printing plate carriers 12 are automatically driven by three adjustment drives. The control function is implemented by a control unit which in the preferred embodiment mode is connected to the computer. This computer automatically aligns the positions and then accordingly adjusts the printing plate 12 together with the printing plate 14.

In an alternative embodiment mode of the present invention, instead of adjusting the position of the printing plate carrier 12, the object carrier 38 may be driven by three adjustment drives and the particular position of the object carrier 38 is adjusted by the computer by means of the control unit to the particular printing stage, respectively.

Besides relating to a pad printing machine, the basic concept of the present invention also includes a method for printing objects 8 respectively a method to register a pad printing machine 1 using the following procedural steps: After an image has been produced at least of parts of the printing plate zone 10 of a second printing stage, this image (which also may be a continuous stream of images) is compared with a reference image. Alternatively, the generated image also might be analyzed, that is for instance prominent coordinates might be ascertained manually or in automated manner and then compared with reference data. Moreover other image-comparing respectively image-analyzing procedures having the same purpose (namely position determination for a subsequent position adjustment) are conceivable.

This comparison determines the second printing stage's printing plate zone position relative to a setpoint position given by the reference data. Thereupon corrective steps are taken to compensate the deviation of the printing plate zone from its setpoint position. The corrective steps may be either in the manner of displacing parts of the printing plate zone 10—in particular that area where the printing plates 14 are held or mounted, into a setpoint position, or In the form of (electronically) storing the deviation from the setpoint in order to subsequently communicate the deviation to the object carrier 38 when printing the object 8, whereby the carrier is able to move into its optimal position in every printing stage. In the above preferred embodiment modes, all printing stages except the first are moved to be in register in a manner that an image shall be recorded also in the first printing stage, this first printing stage image forming the reference data. Such recording is carried out after optimizing the print position on the object 8 for the first printing stage. In this manner a comparison can be ascertained with the reference data that determine a setpoint. When resuming object printing with another print than before, all printing stages may also be adjusted to a corresponding, stored reference value respectively to corresponding reference data.

In summary, the method of the present invention is carried out as follows:

1. Making printing plates with a rigorous relation between the print image (all inks/colors) to the defined and fixed position of the register marks.
2. Mounting the printing plates on the printing machine's printing plate carriers.
3. Transferring the first print image (first ink/color) to the object.

4. Checking the print position and adjusting/registering the first printing plate by means of the x-y platform until—or adjusting/registering the object carrier with object until—the proper position on the object has been attained.
5. Storing the register marks of this printing plate relative to the "optics" in the computer as "masters".
6. Adjusting all other inks/colors by means of the appropriate associated adjustment of printing plate respectively x-y platform (monitor-work).
7. As a result, all colors/inks are fully in register with one another and printing may begin at once (provided the colors/inks and the pads are ready).

Instead of the adjustment of the printing plate respectively the x-y platform, in step 6, in an alternative mode of implementation, a correction of the position of the object carrier 38 will be ascertained and stored in the control unit in each case. During printing, the control unit then moves the object carrier into the correction position stored for the particular printing stage.

Any transmission defects (position shifts) resulting from mechanical tolerances (for instance gearing pitch defects) are intrinsic to and individualistic of machinery and may be calibrated once for all or even repeatedly.

The advantage offered by the present invention is that the alignment of the register of a polychrome print is absolutely perfect and very quick, and renders superfluous the otherwise required experience and manual nimbleness of the operator which by now is no longer commonplace on production floors.

The invention is especially applicable to turntable printing machines though also to any other designed for multi-stage printing.

Even though conceivable, further advantageous combinations have been described above in particular but non-limiting manner, the present invention, it does also include any conceivable further combinations such as defined in non-limiting manner in particular in the dependent claims. All features disclosed in the application documents are claimed as being inventive to the extent that per se or in combination they be novel over the state of the art.

The invention claimed is:

1. A pad printing machine to print an object in at least two printing stages, said machine comprising at least one pad carrier and at least two printing plate zones into each of which a printing plate can be positioned, wherein said pad printing machine further comprises at least one image recorder generating an image of at least one partial area of at least one of said two printing plate zones, and at least a comparator to compare the image generated by the image recorder with reference data, wherein the comparator includes a system comparing the generated image with a reference image.

2. Pad printing machine as claimed in claim 1, wherein the at least one image recorder is configured to generate the reference data that contains an image of at least portions of the printing plate zone of the corresponding printing stage.

3. Pad printing machine as claimed in claim 1, wherein one printing plate zone is provided for each printing stage and each zone is fitted with at least one printing plate.

4. Pad printing machine as claimed in claim 3, wherein each printing plate is fitted with at least one register mark.

5. Pad printing machine as claimed in claim 1, wherein each printing plate zone is fitted with a position-adjustable printing unit carrier including an angularly adjustable x-y platform on/to which is affixable in each case one/the printing plate.

6. Pad printing machine as claimed in claim 1, wherein the image recorder is fitted with two cameras.

7. Pad printing machine as claimed in claim 1, wherein the image recorder includes at least one CCD camera.

8. Pad printing machine as claimed in claim 1, further comprising a position-adjustable object carrier configured to change an object position relative to a pad as a function of a result of the comparison implemented by the comparator.

9. Pad printing machine as claimed in claim 8, wherein the comparator includes a memory appropriate to store the object position relative to the pad as a function of a result of the comparison carried out by the comparator for each printing stage.

10. Pad printing machine as claimed in claim 9, wherein the comparator comprises a memory appropriate to adjust the object position relative to a pad as a function of the position stored for each printing stage.

11. A pad printing machine for printing an object in first and second stages, said machine comprising:

first and second printing plate zones;

a plate carrier configured to carry a printing plate displaceable to the first and second printing plate zones;

an image recorder configured to generate a second image of the second printing plate zone; and a comparator configured to compare the second image of the second printing plate zone with a reference image.

12. The pad printing machine according to claim 11, wherein the image recorder is configured to generate a first image of a partial area of the first printing plate zone as the reference image.

13. The pad printing machine according to claim 12, wherein the image recorder is configured to generate a continuous sequence of individual second images of the second printing plate zone, and the comparator is configured to compare the first image with the continuous sequence of individual second images of the second printing plate zone in real time.

14. The pad printing machine according to claim 11, wherein the comparator comprises a display device configured to display the first image and the second image placed over the first image.

15. The pad printing machine according to claim 14, wherein the comparator is configured to compare arbitrary points of the first and second images on the display device.

16. A device, comprising:

a pad printing machine configured to print an object in at least two stages, said machine comprising at least one pad carrier and at least two printing plate zones configured such that into each of which a printing plate can be positioned, wherein said pad printing machine further comprises at least one means for generating an image of at least one partial area of at least one printing plate zone; and at least a comparator to compare the image generated by the means for generating an image with reference data.

17. The device of claim 16, wherein the comparator is configured to compare the image generated by the means for generating an image with a reference image.

* * * * *